United States Patent [19]

Kosugi et al.

[11] Patent Number: 4,921,422

[45] Date of Patent: May 1, 1990

[54] METHOD FOR CONTROLLING THE PREHEATING ZONE OF A TUNNEL KILN

[75] Inventors: Tatsuhiro Kosugi; Takeshi Ogawa, both of Kitakyushu; Norio Tanaka, Tokyo, all of Japan

[73] Assignee: Toto, Ltd., Fukuoka, Japan

[21] Appl. No.: 347,261

[22] Filed: May 3, 1989

Related U.S. Application Data

[63] Continuation-in-part of Ser. No. 36,199, Apr. 8, 1987, abandoned, which is a continuation of Ser. No. 745,012, Jun. 14, 1985, abandoned.

[30] Foreign Application Priority Data

Jun. 14, 1984 [JP] Japan ..... 59-122217

[51] Int. Cl.[5] ..... F27D 7/00; F27B 9/02

[52] U.S. Cl. ..... 432/24; 432/145; 432/148; 432/152; 432/186; 432/128

[58] Field of Search ..... 432/22, 148, 150, 152, 432/164, 186, 189, 190, 193, 198, 201, 205, 143-145, 128, 130, 133, 248, 236, 238

[56] References Cited

U.S. PATENT DOCUMENTS

| | | | |
|---|---|---|---|
| 1,725,129 | 8/1929 | Carpenter et al. | 432/152 |
| 2,180,041 | 11/1939 | Durieux | 432/189 |
| 3,119,166 | 1/1964 | Ostermaier | 432/164 |
| 3,170,681 | 2/1965 | Davies | 432/186 |
| 3,860,222 | 1/1975 | Tennenhouse | 432/205 |
| 3,982,887 | 9/1976 | Kendziora et al. | 432/152 |
| 4,140,479 | 2/1979 | Sirch et al. | 432/152 |
| 4,249,895 | 2/1981 | Mantegani | 432/145 |
| 4,493,641 | 1/1985 | Hubbert | 432/148 |
| 4,527,974 | 7/1985 | Carraroli et al. | 432/145 |

*Primary Examiner*—Henry C. Yuen
*Attorney, Agent, or Firm*—Harry M. Weiss

[57] ABSTRACT

This disclosure is directed to a method for controlling the preheating zone of a tunnel kiln which includes firing and cooling zones. The method comprises forcedly blowing air from the entire ceiling portion of the preheating zone in the downward direction to diffuse hot combustion gas present in the upper portion and to reducing a difference in temperature between the upper and lower portions of the preheating zone. Air may be blown into the preheating zone at a flow rate determined from the quantity of the combustion gas within the preheating zone.

1 Claim, 2 Drawing Sheets

METHOD FOR CONTROLLING THE PREHEATING ZONE OF A TUNNEL KILN

BACKGROUND OF THE INVENTION

1. Related Applications

This is a continuation-in-part of U.S. Ser. No. 036,199, filed Apr. 8, 1987, now abandoned, which is a continuation of U.S. Ser. No. 745,012 filed June 14, 1985, now abandoned, which is based upon a Japanese parent patent application No. 122217/1984 June 14, 1984.

2. Field of the Invention

The present invention relates to a tunnel kiln for firing ceramic products, and more particularly, to a method for controlling a preheating zone of the tunnel kiln. In such a tunnel kiln, there are generally three zones, the preheating, firing and cooling zones, having a heat curve over the whole thereof so as to fire products during their passage through these zones.

3. Description of the Prior Art

In such prior art tunnel kilns, the following problems have arisen in a portion of the preheating zone which is at a lower temperature. To ensure that heat input can be effectively utilized with a smaller loss of heat, the combustion gas may be drawn from the firing zone into the preheating zone by sucking the combustion gas, as much as possible, through suction ports in the side walls of the kiln at the lower temperature area of the preheating zone to efficiently conduct a heat exchange between the combustion gas and products. However, a negative pressure may be created in the lower portion of the preheating zone because of the buoyancy of the combustion gas. This negative pressure may increase due to the suction of the combustion gas into the flues, so that cold air violently flows through an inlet of the kiln and an underground passage into the preheating zone, resulting in an increase in the temperature difference between the hotter upper portion and the cooler lower portion of the preheating zone. In firing large products, the increased vertical temperature gradient may cause the products to be exposed at their upper portion to a higher temperature and at their lower portion to a lower temperature. For this reason, at the stage of evaporation of deposited water and water of crystallization, a difference in shrinkage of volume is produced between the interior and exterior as well as between the upper and lower portions of the products to cause internal strain in the products, so that defects such as cracks or the like may be easily generated in the products. On the other hand, if the combustion gas is drawn from the firing zone into the higher temperature area of the preheating zone by sucking the combustion gas through the flue suction ports at the higher temperature area of the preheating zone into the flues in order to minimize the flow of cold air through the kiln inlet and the underground passage into the preheating zone, it is impossible to efficiently conduct the heat exchange between the combustion gas and the products because the hot combustion gas immediately flows out of the kiln, resulting in an increased loss of heat. In addition, the temperature in the lower temperature area of the preheating zone decreases and consequently, satisfactory preheating of the products is not effected. Further, in the prior art method, it is difficult to set any derived heat curve in the preheating zone.

Exemplary of the prior art is Japanese Utility Model Public Disclosure Sho No. 57-160098.

To overcome the above-mentioned problem, blowing ports are provided in the opposite shoulders of the kiln at its preheating zone to blow air downward. In this case, while the vertical temperature gradient may be reduced to some extent in the vicinity of the inner walls of the kiln, a significant reduction in gradient of temperature cannot be obtained at the central position where the products exist.

SUMMARY OF THE INVENTION

It is therefore an object of the present invention to provide a method for controlling a preheating zone of a tunnel kiln, which is effective in overcoming the above problems, wherein the vertical temperature gradient in the preheating zone can be significantly reduced across the full width of the kiln.

According to the present invention, this object is accomplished by providing a method for controlling a preheating zone of the tunnel kiln, wherein air is forcedly blown downward from the entire ceiling portion of the kiln at the preheating zone at the flow rate dependent on the quantity of the combustion gas within the kiln preheating zone to diffuse the hot combustion gas present in the upper portion to the lower portion of the preheating zone, thereby reducing the vertical temperature gradient in the preheating zone. The blowing of air is conducted by feeding air from its source provided outside the kiln into air blowing means which are arranged at appropriate intervals throughout the ceiling of the kiln at the preheating zone and extend in the direction perpendicular to the longitudinal axis of the kiln.

BRIEF DESCRIPTION OF THE DRAWING

The above and other objects, features and advantages of the present invention will become apparent from the following description of the preferred embodiment taken in conjunction with the accompanying drawings in which.

DESCRIPTION OF THE PREFERRED EMBODIMENT

Figure 1:
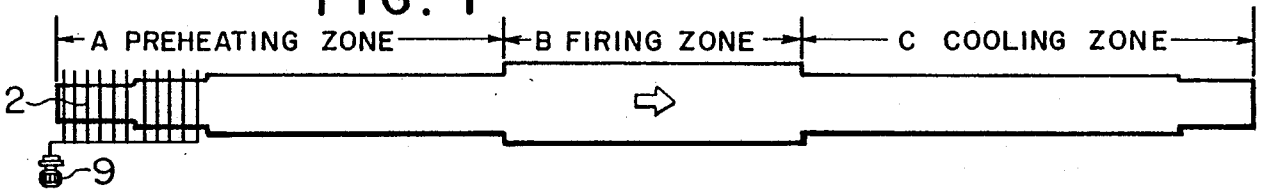
FIG. 1 is a plan view of the whole tunnel kiln to which is applied a method for controlling a preheating zone of the tunnel kiln according to the present invention.
Figure 2:
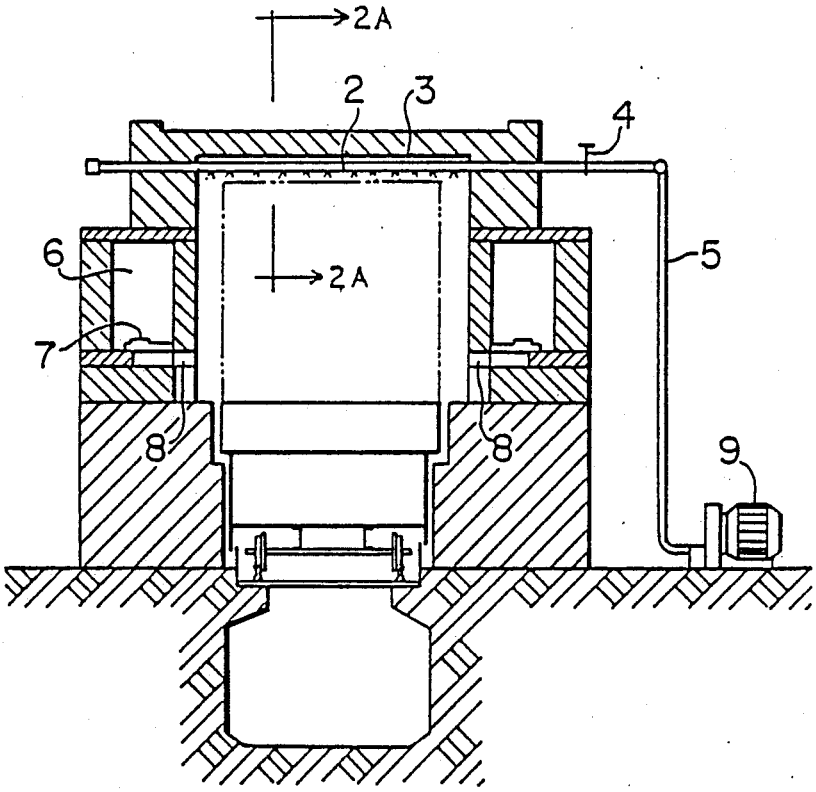
FIG. 2 is a sectional view of the preheating zone of the tunnel kiln shown in FIG. 1.
Figure 2A:
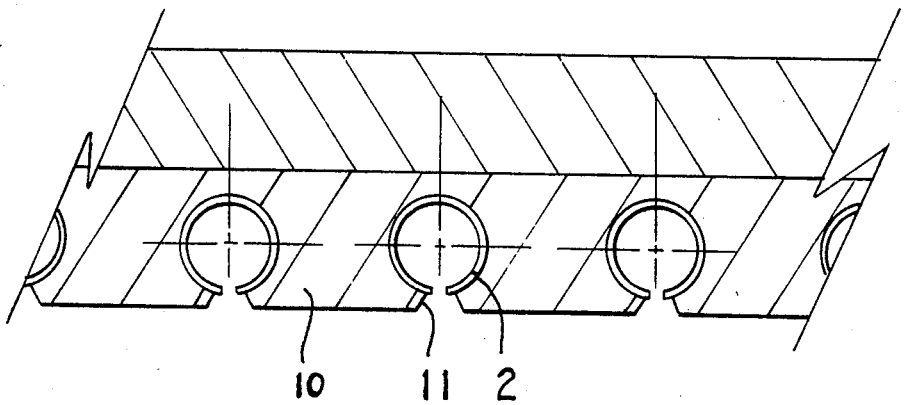
FIG. 2A is a cross-section view of a portion of the ceiling of the tunnel kiln.

As shown in FIGS. 1, 2 and 2A, there is shown a tunnel kiln for ceramic products to which is applied a method for controlling a preheating zone according to the present invention. The tunnel kiln comprises three zones: a preheating zone A, a firing zone B and cooling zone C, as shown in FIG. 1. At the preheating zone A, the kiln is provided with flue suction ports 8 formed in the side walls thereof, through which the combustion gas is sucked from the firing zone B into flues 6 so that it is drawn into the preheating zone A. The suction of the combustion gas into the flues 6 is controlled by dampers 7 for opening and closing the suction ports 8. The preheating zone is provided with a plurality of perforated hollow pipes 2 extending in a direction perpendicular to the longitudinal axis of the kiln and disposed in close vicinity to a ceiling 3 of the kiln at appropriate intervals along the longitudinal axis of the kiln to constitute air blowing means. A device such as a ring blower 9 which is a source of air is connected through a conduit 5 to the hollow pipes 2 to feed pressurized air into the hollow pipes, thereby blowing it downward through holes in the hollow pipes into the preheating zone of the kiln. In said kiln, hollow pipes are protected by refractories, and the pressurized air is heated in advance to a temperature higher than a dew point of the combustion gas. Preheating of air can be conducted by passing air through a heater located at the outside of the kiln or the preheated air may be introduced from the cooling zone of the kiln. A valve 4 is provided in each of the hollow pipes 2 to adjust the flow rate of air therethrough depending on the quantity of the hot gas within the kiln. The air blowing means may be divided into units each including one or more hollow pipes and mounted in the preheating zone in parallel with each other. By blowing the air into the preheating zone from the ceiling portion of the kiln toward the lower portion thereof in the above manner, the pressure in the lower portion of the preheating zone and that in the passage under the kiln and at the kiln inlet will become substantially equal, thus preventing cold air from flowing into the preheating zone. Moreover, the hot combustion gas at the upper portion of the preheating zone is diffused to its lower portion and therefore, it is possible to extremely reduce a difference in temperature between the upper and lower portions of the preheating zone, as shown in FIG. 3.

Figure 3:
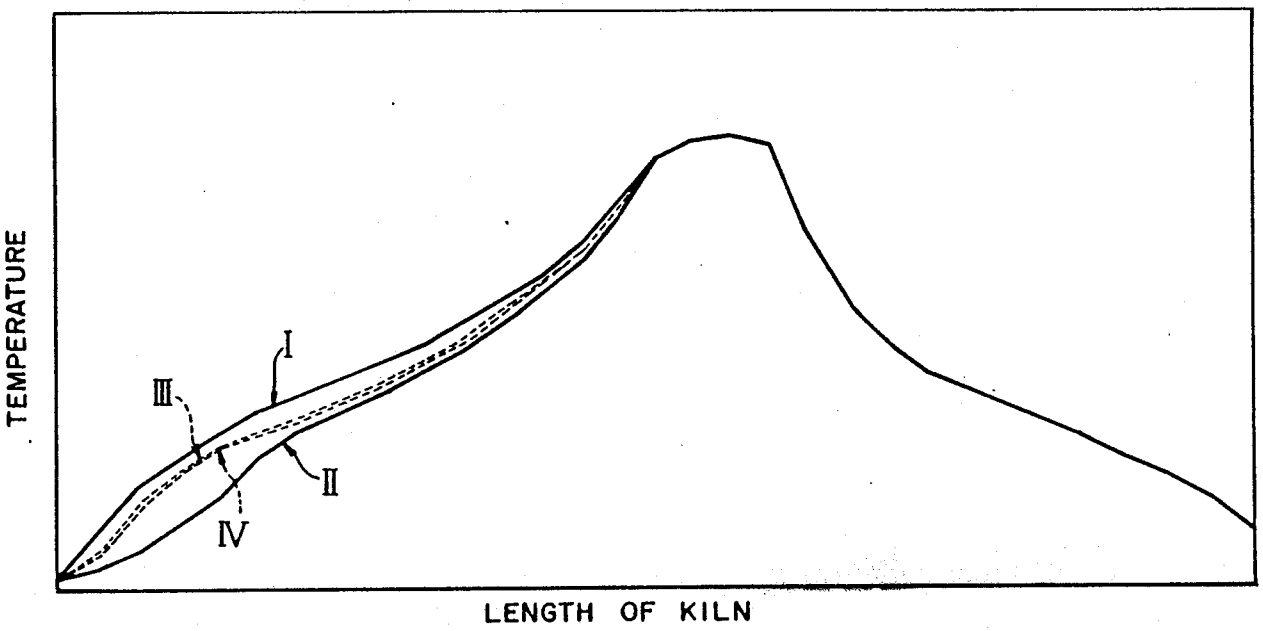
FIG. 3 is a diagram of temperature curves set within the tunnel kiln by the methods according to the prior art and the present invention, respectively.

In FIG. 3, I and II show temperature curves in the upper and lower portions within the kiln, respectively, obtained by the prior art method while III and IV show temperature curves in the upper and lower portions within the kiln, respectively, obtained by the method according to the present invention.

One of the problems arising due to the blowing of air is a dewing. As the combustion gas is drawn from the firing zone into the preheating zone and its temperature is lowered, this gas is oversaturated to form mists, i.e., to become dewed on the kiln wall, carriages or the like. Because this dewed water is acidic, its drops may adversely affect products upon falling thereonto. For this reason, it is necessary to avoid any dewing on the ceiling of the kiln, and therefore air to be forcedly blown is preheated to a temperature above a dew point of the combustion gas. In this case, the perforated hollow pipes can be mounted in the kiln in a directly exposed relation to the interior of the kiln. With the use of air having a temperature lower than the dew point, the perforated hollow pipes can be protected by refractories 10 to prevent the gas from dewing. Slits 11 are formed in the refractories 10 for exposing the perforated hollow pipes 2. Slits 11 are formed in the refractories 10 for blowing the air therethrough. Refractories may be positioned on the ceiling of the tunnel kiln to define an air chamber or chambers therebetween, from which air is blown through spaces defined between the two adjacent refractories.

Materials, from which the hollow pipes are formed, include pottery bodies, cordierite, mullite, silicon carbide, silicon nitride, alumina, or sialon, or heat-resisting steels, or the like, those having heat and corrosion resistance properties and dense structures, and any one of these materials can be selected depending on a required temperature region. The pitch between the adjacent hollow pipes may be about 100 to about 1000 mm, preferably about 300 to about 500 mm. The diameter of each of the hollow pipes may be about 10 to about 100 mm, preferably about 40 to about 50 mm. The holes in each of the hollow pipes, through which air is blown, may be circular, oval or polygonal, but in general, circular holes are used. The diameter of each of the holes in the hollow pipes is determined depending on the sectional area of the kiln and the flow rate and pressure of air or the like. The smaller the pitch between the two adjacent holes in the hollow pipes, the better the result that is obtained, but the pitch can be determined depending on the sectional area of the kiln and the flow rate and pressure of air. The holes in the hollow pipe may be tapered. Refractories for protecting the perforated hollow pipes and the refractories for formation of the air chamber or chambers described hereinbefore which serve as the air blowing means may be of any suitable materials having heat and corrosion resistant properties, and including calcium silicate, alumina, chamotte or the like. The spaces defined by the spaced-apart refractories can be in rectangular elongated form and have a width which is determined from the sectional area of the kiln and the flow rate and pressure of air. The air is generally blown through the air blowing means in the vertical and downward direction, but may be blown at any angle. The flow rate and pressure of air to be blown through the air blowing means depend on the quantity of the combustion gas generated in the kiln, but may be so adjusted that the flowing air does not fling up debris (such as brick debris, joint debris, porcelain debris and the like) in the lower portion of the kiln. In the preferred embodiment shown in the drawing, the kiln has its flat ceiling on which the air blowing means are located. However, if the ceiling of the kiln is arched, it is desirable to position the air blowing means along the arch of the ceiling.

With such an arrangement of a tunnel kiln according to the present invention, a difference in temperature between the upper and lower portions of the preheating zone within the kiln is significantly reduced so that products can be uniformly preheated, leading to an improved quality and yield of products. In addition, a heat curve in the preheating zone is easily set so that the kiln can be operated with a high efficiency. Further, the combustion gas can be drawn to the inlet of the kiln, thus making it possible to utilize heat input effectively and conveniently and to provide energy savings.

What is claimed is:

1. In the method of controlling the temperature gradient of a preheating zone of a tunnel kiln having a combustion gas therein, the steps of:

heating air to a temperature higher than the dew point of said combustion gas;

forcedly blowing said heated air through a plurality of perforated hollow pipes that extend generally perpendicularly to the longitudinal direction of said kiln, said pipes being disposed at a plurality of longitudinal intervals in an upper portion of said preheating zone;

partially protecting said pipes with refractories having slits formed therein that expose said pipes; and regulating the blowing of said heated air from said upper portion to a lower portion of said preheating zone to diffuse any of said combustion gas in said upper portion and reduce the temperature gradient between said upper and lower portions.

* * * * *